US008002973B2

(12) United States Patent
Jacobs et al.

(10) Patent No.: US 8,002,973 B2
(45) Date of Patent: Aug. 23, 2011

(54) LUBRICANT PURIFICATION SYSTEM

(75) Inventors: William A Jacobs, Lake Worth, FL (US); Brian A Jacobs, Lake Worth, FL (US); Frank W Lotz, Boynton Beach, FL (US)

(73) Assignee: Puradyn Filter Technologies, Inc., Boynton Beach, FL (US)

( * ) Notice: Subject to any disclaimer, the term of this patent is extended or adjusted under 35 U.S.C. 154(b) by 747 days.

(21) Appl. No.: 12/111,357

(22) Filed: Apr. 29, 2008

(65) Prior Publication Data

US 2011/0056877 A1 Mar. 10, 2011

(51) Int. Cl.
*B01D 36/02* (2006.01)

(52) U.S. Cl. ..... 210/85; 210/202; 210/209; 210/315; 210/489

(58) Field of Classification Search ..... 210/489, 210/209, 201, 206, 85, 202, 315
See application file for complete search history.

(56) References Cited

U.S. PATENT DOCUMENTS 5,078,877 A * 1/1992 Cudaback et al. ..... 210/315
6,113,784 A * 9/2000 Stoyell et al. ..... 210/493.2
6,919,023 B2 * 7/2005 Merritt et al. ..... 210/209

* cited by examiner

*Primary Examiner* — Terry K Cecil
(74) *Attorney, Agent, or Firm* — Allen D. Hertz

(57) ABSTRACT

A lubricant reclamation system having a reclamation device (100) is sectioned into three processing sections: a centralized core section (150), a peripheral filtering section (170), and a base filtering section (190). A series of peripheral conduits (172, 182) are disposed within the peripheral filtering section (170) having an entrance port (174) in communication with an inlet manifold (105) and discharging via an exit port (176) in communication with the base filter (190), a peripheral filtering material (178), or the core filtering section (150). The peripheral conduits (172, 182) can be linear, multi-directional, tapering, and spiraling. The filter is in fluid communication with a series of stacked reclamation members (130, 140). The stacked reclamation members (130, 140) provide processing and/or monitoring of the lubricant via electrical or pneumatic interface.

24 Claims, 12 Drawing Sheets

LUBRICANT PURIFICATION SYSTEM

BACKGROUND OF THE INVENTION

1. Field of the Invention

The present invention relates to an oil reclamation system and more specifically to an oil purification system incorporating a three-section reclamation configuration and series of stacking purification members.

2. Discussion of the Related Art

This invention relates to fluid reclamation and purification devices, which are preferably used in conjunction with engines using lubricating oils or hydraulic systems. More particularly, the present invention provides several unique oil/lubricant treatment means creating a unique system for reconditioning.

Oil reclamation devices are known to incorporate an evaporator head having a heat-transmitting member mounted within a cavity. The heat-transmitting device can incorporate baffles to form a baffled evaporator chamber.

Oil filters are provided in a variety of form factors and materials. Common filters comprise a filtering medium disposed within a canister and sealed via a top member. A mechanical interface, such as a threaded interface, and fluid transfer means, such as an oil inlet and an oil outlet, are integrated into the top member. The filtering materials can be a paper product, a synthetic filtering material, and the like.

Oil reclamation devices can additionally include soluble oil additives for enriching the oil over a period of time. The additives are positioned within the filter in a section between the particle filtering material and a felt pad. The additives are placed to contact the oil and formulated to dissolve over a period of time.

Thus, what is desired is a lubrication reclamation system providing optimal control of the purification process. Additionally, designed is the ability for the end user to tailor the configuration for both purification and monitoring via a plurality of stacked array members.

SUMMARY OF THE INVENTION

The present invention is directed to a lubricant reclamation system comprising a plurality of stackable conditioning members in linear fluid communication with each adjacent member and at least one filtering component.

In a first aspect of the present invention, a filter comprising a filter housing having a mounting feature, an oil inlet conduit, an oil exit conduit, a centralized core filter section, a peripheral filter section, a base section filter, and a plurality of peripheral fluid conduits located in fluid communication between said peripheral core filter and centralized core filter sections.

While another aspect of the present invention provides a fluid reclamation pathway from said peripheral filter section to said base section filter to said centralized core filter section.

Yet another aspect introduces various geometric options for said peripheral fluid conduits, including:

a. Vertically disposed between an oil inlet surface and a base section filter;
b. Vertically disposed from an oil inlet surface projecting towards said base section filter;
c. Tapering;
d. A substantially vertical pathway redirected to a substantially;
e. Horizontal pathway;
f. Spiraling; and g. Disposed between said oil inlet surface and any of a variety of differing lubricant filtration members disposed within and circumferentially about said centralized core filter section.

Wherein another aspect incorporates a filtering medium disposed within said peripheral fluid conduits.

Another aspect of the present invention provides stackable conditioning members as interlocking rings, each in fluid communication with the adjacent ring.

In another aspect of the present invention, wherein at least one interlocking ring introduces a fluid purification process to the lubricant as the lubricant passes through said interlocking ring.

While another aspect of the present invention provides at least one interlocking ring comprising a monitoring device which gathers at least one measure of a state of the lubricate as the lubricate passes through said interlocking ring.

Yet another aspect provides a filter comprising a filtering core section having a first filtering configuration, and a filtering peripheral section comprising a second filtering configuration.

With yet another aspect incorporating a sludge filter section located at a distal end from the oil filter oil inlet and mounting face.

And another aspect provides a wall of the peripheral conduits having electrically conductive properties being in electrical communication with the electrical interface of the electrically driven processing array member.

While another aspect incorporates a plurality of core filter material laminates are a three-ply design causing liquid resonance.

Yet another aspect fabricates the three-ply design having an outermost permeable laminate, a central permeable laminate, and an innermost permeable laminate.

With another aspect providing an electrical current through at least one of the outermost permeable laminate, the central permeable laminate, and an innermost permeable laminate, the electrical current being provided via electrical communication with the electrical interface of the electrically driven processing array member.

Another aspect provides a knit section being designed in a variety of heights, wherein the heights can optionally be adjustable via snaps, ties, buttons and any other reasonable mechanical fastener.

These and other features, aspects, and advantages of the invention will be further understood and appreciated by those skilled in the art by reference to the following written specification, claims and appended drawings, which follow.

BRIEF DESCRIPTION OF THE DRAWINGS

For a fuller understanding of the nature of the present invention, reference should be made to the accompanying drawings in which.

Like reference numerals refer to like parts throughout the several views of the drawings.

DETAILED DESCRIPTION OF REPRESENTATIVE EMBODIMENTS

Figure 1:
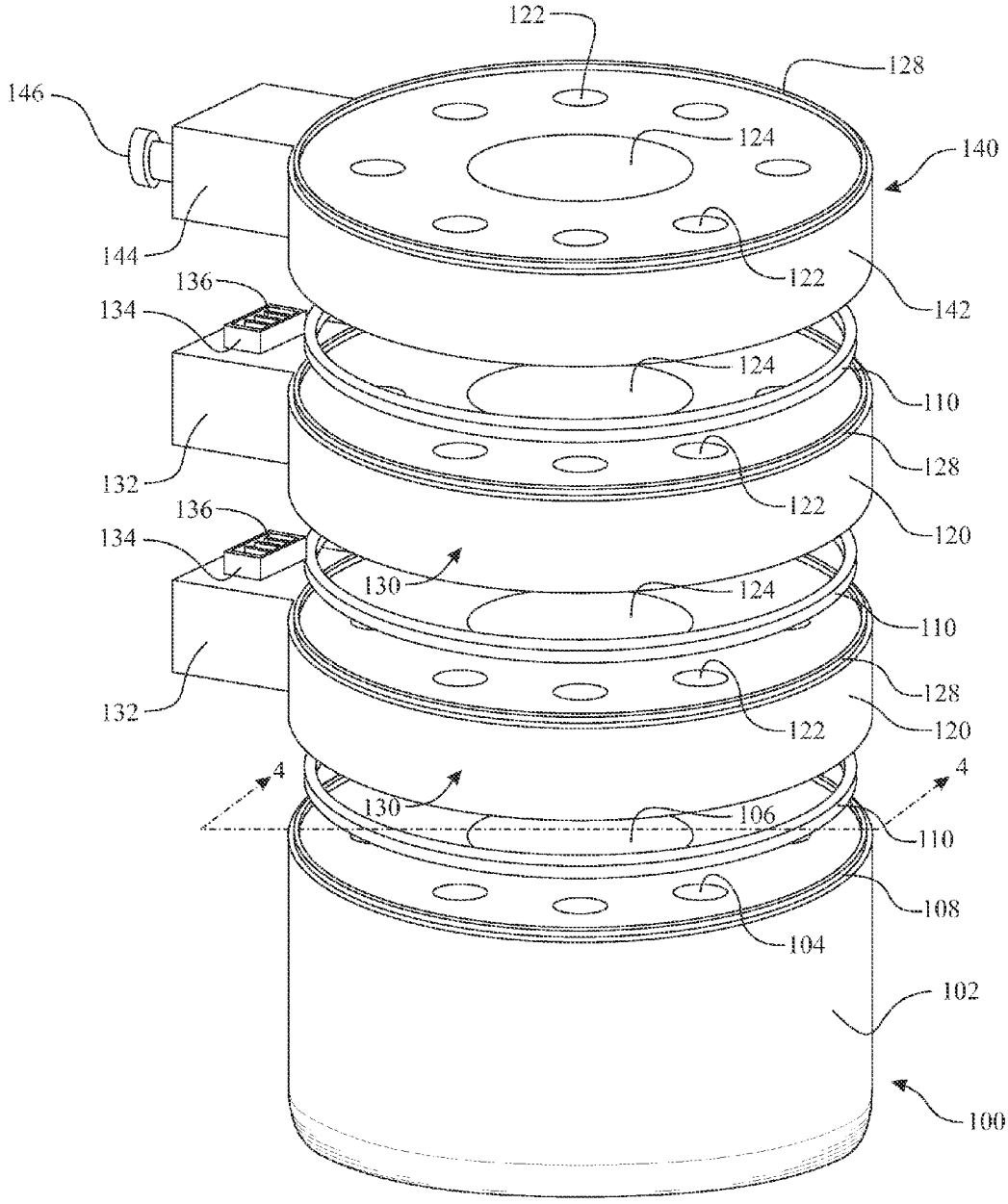
FIG. 1 presents an exploded perspective view of an exemplary embodiment of the lubricant reclamation system.

For purposes of description herein, the terms "upper", "lower", "left", "rear", "right", "front", "vertical", "horizontal", and derivatives thereof shall relate to the invention as oriented in FIG. 1. However, one will understand that the invention may assume various alternative orientations and step sequences, except where expressly specified to the contrary. Therefore, the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

A reclamation device, generally referenced as 100, is presented throughout the disclosure illustrating several exemplary configurations. The effectiveness of the enclosed reclamation apparatus 100 can be enhanced via at least one stackable and interchangeable lubrication processing ring as presented in FIG. 1.

An enclosed reclamation apparatus 100 engages in fluid communication with an electrical array member 130. Either a second electrical array member 130, or a pneumatically operated array member 140 can be disposed upon the opposing side of the electrical array member 130. The exposed end of the enclosed reclamation apparatus 100, electrical array member 130, or pneumatically operated array member 140 engages in fluid communication with a lubrication reclamation interface (not shown, but well understood). The lubrication reclamation interface can be a bracket, a mounting feature directly attached to the power plant/engine, a remote bracket (such as for an oil sump configuration), and the like. A pliant seal 110 is affixed upon a seal feature 108 or a processing seal feature 128 and is sandwiched between of each interface providing a fluid seal. Lubricant flows into a series of processing lubricant inlet conduits 122, which create a flow path for passing through each of the pneumatically operated array member 140 and electrical array member 130 into lubricant inlet ports 104 of the enclosed reclamation apparatus 100. The lubricant is processed within the enclosed reclamation apparatus 100 and returns for use via a passage created by a lubricant outlet port 106 and each of the respective processing lubricant outlet conduits 124. The electrical array member 130 is fabricated having an electrically operated lubricant processing body 120. The electrically operated lubricant processing body 120 includes a plurality of processing lubricant inlet conduits 122 positioned circumferentially about a processing lubricant outlet conduit 124. An electrical receptacle location 132 is disposed upon the electrically operated lubricant processing body 120 providing support for an electrical connector 134. The electrical connector 134 having a series of electrical interface 136 disposed thereon, providing electrical interface to any electrically driven processing device located within the electrically operated lubricant processing body 120. The electrically driven processing device can be a filtration mechanism, a monitoring mechanism, and the like, being operated by electrical power and/or an electrical signal. A plurality of electrical array members 130 can be incorporated into the system via a stacking process as illustrated, each providing a unique electrically driven processing device. The electrically driven processing device is configured being in communication with the lubricant as the lubricate passes through at least one of the processing lubricant inlet conduits 122 and the at least one processing lubricant outlet conduit 124. Each of the series of processing lubricant inlet conduits 122 can include a respective electrically driven processing device, each device can provide similar or different processing characteristics to the others. The selected electrically driven processing devices can be respective to engine use, wear, mileage, and the like.

A pneumatically operated array member 140 provides features that are similar to the electrical array member 130, utilizing a pneumatically driven processing device, such as an oil pressure sensor. The pneumatically operated array member 140 is fabricated having a pneumatically operated lubricant processing body 142. The pneumatically operated array member 140 includes a plurality of processing lubricant inlet conduits 122 positioned circumferentially about a processing lubricant outlet conduit 124. A pneumatic receptacle location 144 is disposed upon the pneumatically operated lubricant processing body 142 providing support for a pneumatic interface 146. The pneumatic interface 146 provides a pneumatic interface between an external mechanism and the pneumatically driven processing device. The pneumatically driven processing device can be a filtration mechanism, a monitoring mechanism, and the like, being operated by pneumatic pressure. A plurality of pneumatically operated array members 140 can be incorporated into the system via a stacking process (in a manner similar to the plurality of electrical array members 130 illustrated), each providing a unique pneumatically driven processing device. The pneumatically driven processing device is configured being in communication with the lubricant as the lubricate passes through at least one of the processing lubricant inlet conduits 122 and the processing lubricant outlet conduits 124. The pneumatic interface 146 can be of any known pneumatic connecting device.

Figure 2:
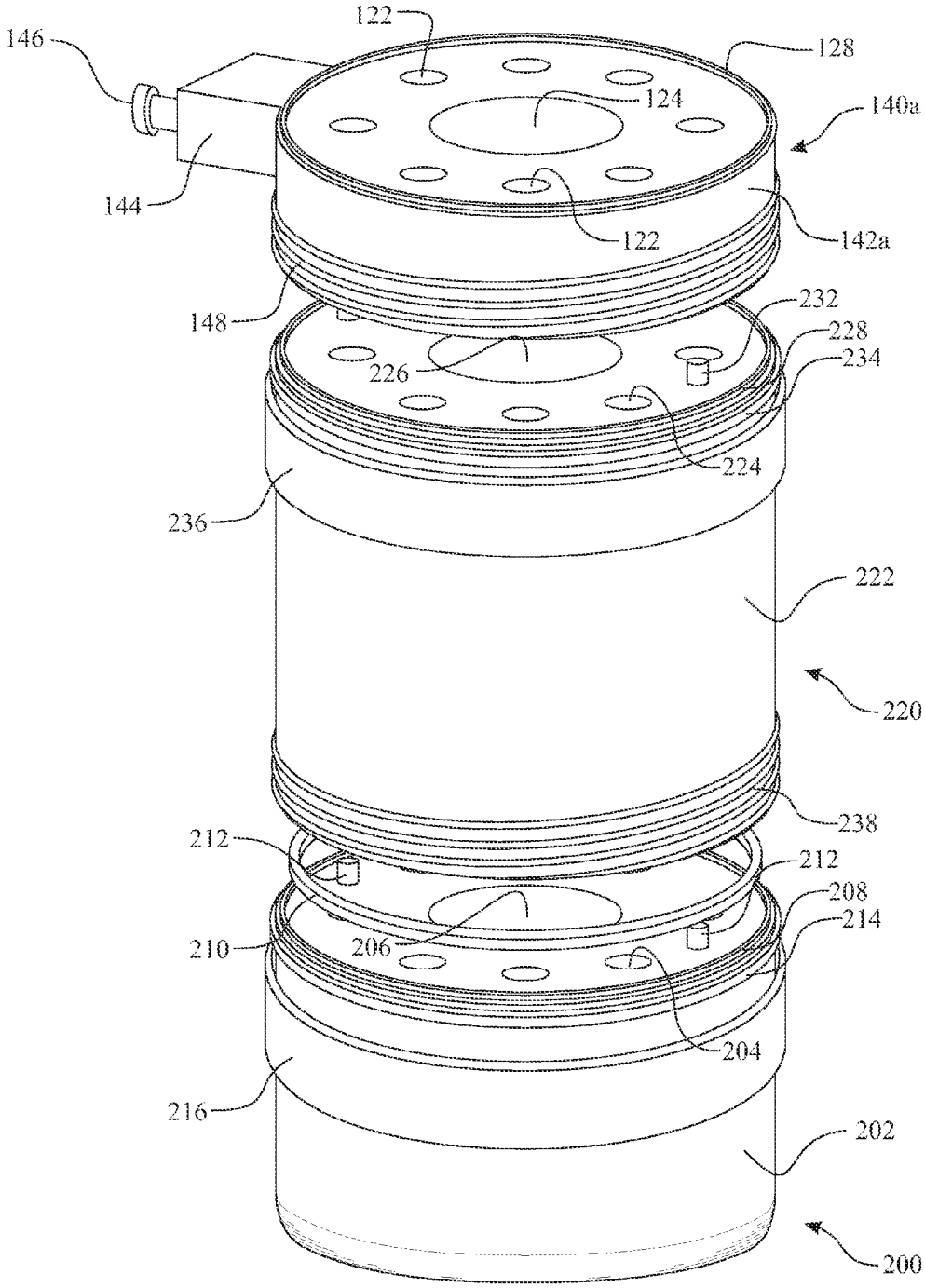
FIG. 2 presents an exploded perspective view of a first alternate exemplary embodiment of the lubricant reclamation system comprising a pass through lubricant reclamation device.
Figure 3:
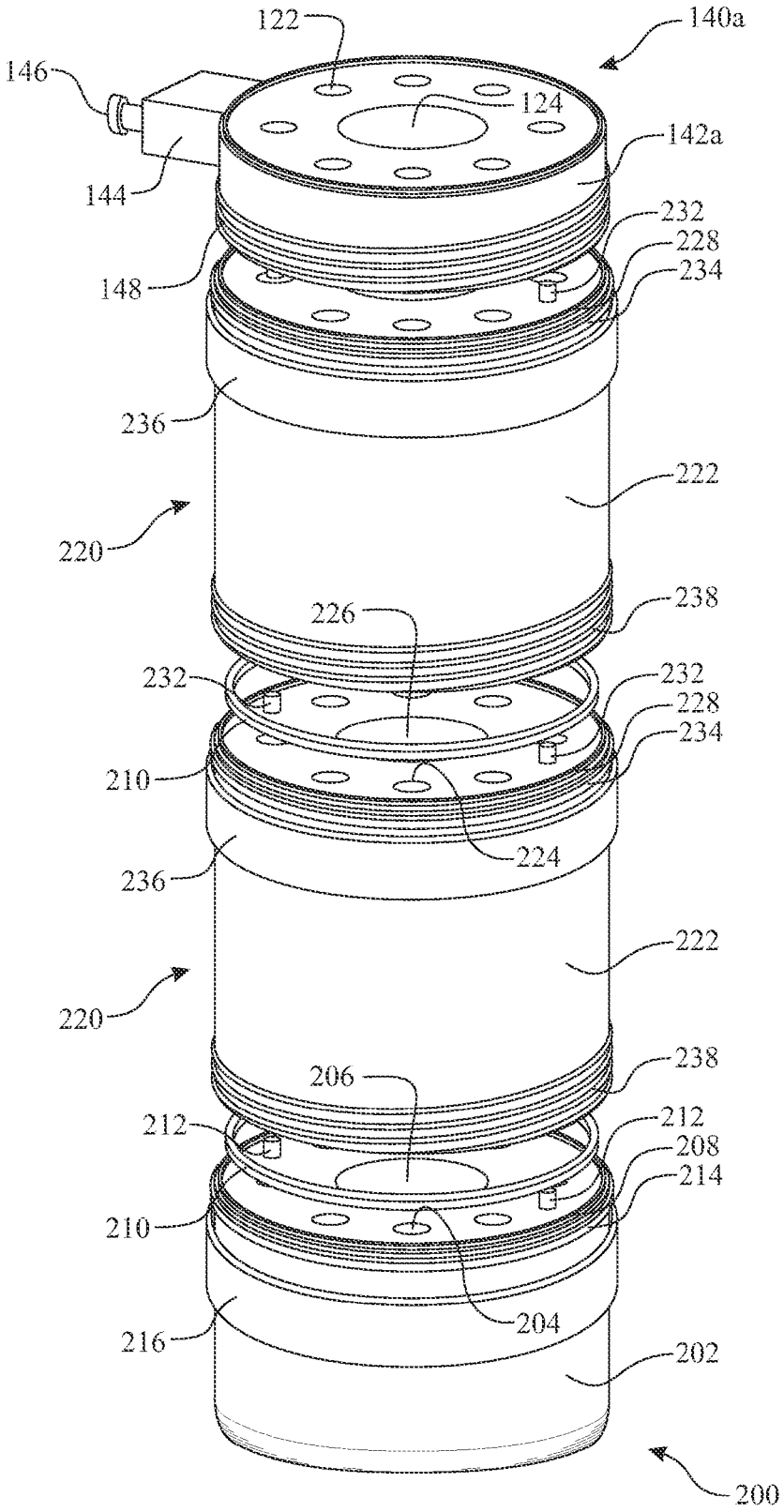
FIG. 3 presents an exploded perspective view of the first alternate exemplary embodiment of FIG. 2, incorporating a plurality of pass through lubricant reclamation devices.
Figure 4:
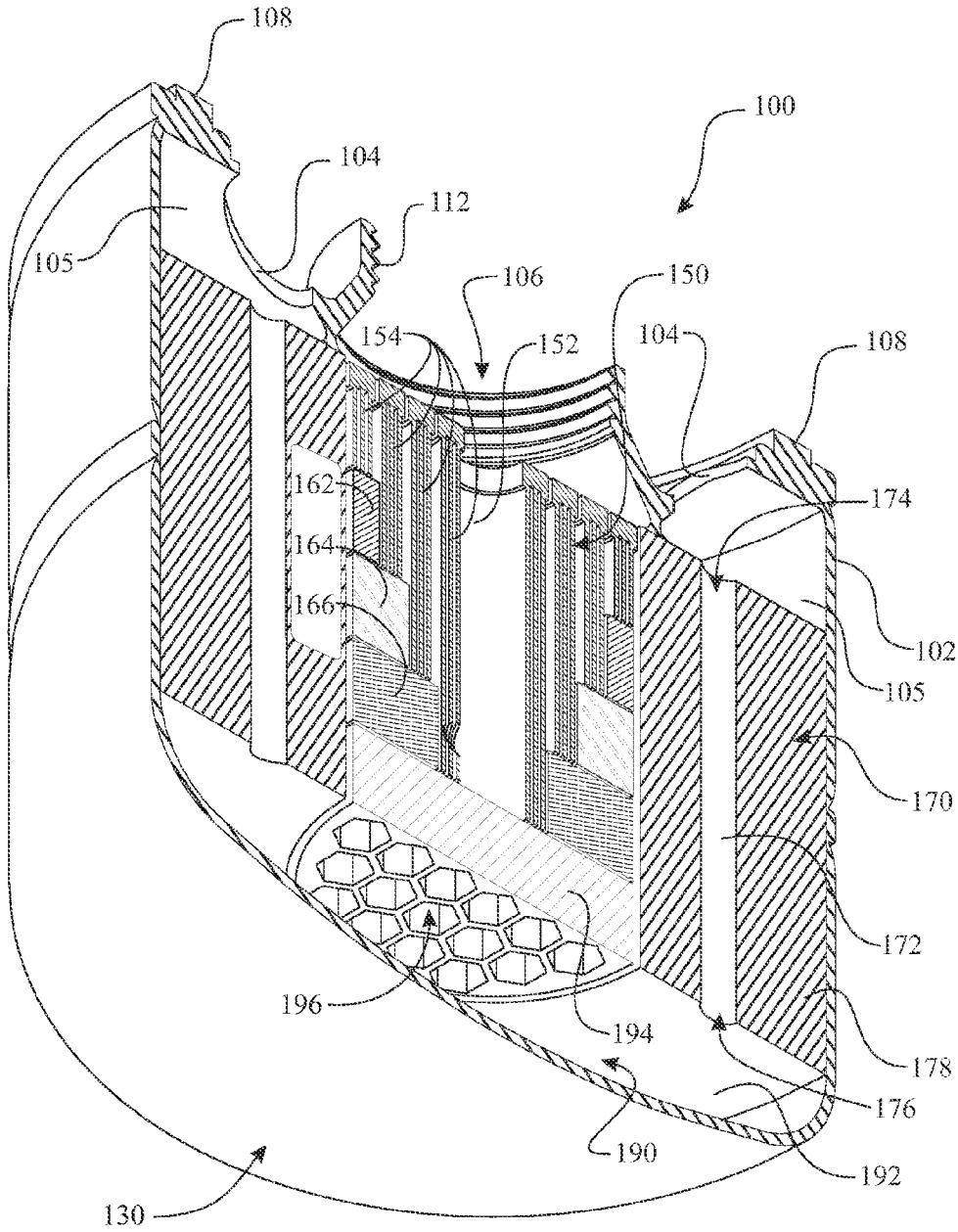
FIG. 4 presents an isometric sectioned view of the enclosed reclamation device taken along section 4-4 of FIG. 1 presenting a first (linear) peripheral flow conduit configuration.

Enhanced configurations of the reclamation system are presented in FIGS. 2 and 3. The enhanced reclamation system couples an enclosed registering reclamation device 200 (contained within a registering filter housing 202) to a pass through reclamation device 220 (contained within a pass through filter housing 222), which is coupled to a pneumatically operated array member 140a. A plurality of pass through reclamation devices 220 can be assembled in series to compensate for desired processing.

The enhanced reclamation system provides enclosed registering reclamation device 200 incorporating features ensuring proper registration between a series of lubricant inlet conduits 204 and a series of lubricant inlet conduits 224 of a pass through reclamation device 220. The exemplary means of ensuring proper registration utilizes a plurality of registration members 212, which engages with an opposing registration feature (not shown but understood), such as a plurality of pins and respective bores. The installer aligns the registration member 212 of the enclosed registering reclamation device 200 to the opposing registration feature of the pass through reclamation device 220, then secures the two reclamation devices 200, 220 via securing a fastening ring 216 about housing intercoupling threads 238. The fastening ring 216 includes a flange which engages with a fastening flange 214 located proximate a coupling edge of a registering filter housing 202 of the enclosed registering reclamation device 200. The lubricant outlet conduit 206 is subsequently registered to the lubricant outlet conduit 226, as each of the ports 206, 226 are all centrally positioned. A pliant seal 210 is placed between the enclosed registering reclamation device 200 and the pass through reclamation device 220 providing a fluid seal. A seal feature 208 provides a mechanical interface for assisting the pliant seal 210 in ensuring the fluid seal.

The enhanced reclamation system further incorporates similar features ensuring proper registration between a series of lubricant inlet conduits 224 and the series of processing lubricant inlet conduits 122 of the pneumatically operated array member 140*a*. The exemplary means of ensuring proper registration utilizes a plurality of registration members 232, which engage with an opposing registration feature disposed upon the mating face of the pneumatically operated array member 140*a*. The installer aligns the registration member 232 of the pass through reclamation device 220 to the opposing registration feature of the pneumatically operated array member 140*a*, then secures the two reclamation devices 140*a*, 220 via securing a fastening ring 236 about an array member intercoupling threading 148 of the pneumatically operated array member 140*a*. The fastening ring 236 includes a flange which engages with a fastening flange 234 located proximate a coupling edge of a pass through filter housing 222 of the pass through reclamation device 220. The lubricant outlet conduit 226 is subsequently registered to the processing lubricant outlet conduits 124, as the port 124 is also centrally positioned. A pliant seal similar to 212 is placed between the mating surfaces of the pass through filter housing 222 and the pneumatically operated lubricant processing body 142*a*. A seal feature 228 provides a mechanical interface for assisting the pliant seal similar to 212 in ensuring the fluid seal.

Details of the internal components of the enclosed reclamation apparatus 100 and the respective design variants are presented in FIGS. 4 through 14. The figures present an enclosed reclamation apparatus 100 having each of the following peripheral conduit geometries:

a. A enclosed reclamation apparatus 100 (FIG. 4) having a plurality of substantially vertical peripheral flow conduits 172 which passes substantially vertically between a lubricant inlet manifold 105 and a base filtering material 192;

b. A enclosed reclamation apparatus 100*a* (FIGS. 6 and 7) having a plurality of substantially vertical peripheral flow conduits 172 which provides a fluid flow path substantially vertical from said lubricant inlet manifold 105 towards said base filtering material 192, and being redirected via a plurality of substantially horizontal peripheral flow conduits 180, exiting via a peripheral conduit exit 176 into a centralized core filter section 150;

c. A enclosed reclamation apparatus 100*b* (FIG. 8) having a plurality of substantially vertical peripheral flow conduits 172*a* which provides a fluid flow path substantially vertical from said lubricant inlet manifold 105 towards said base filtering material 192, tapering from an entrance diameter to a smaller exiting diameter, the discharging diameter being either within a peripheral filtering material 178 or into said base filtering material 192; and d. A enclosed reclamation apparatus 100*c* (FIGS. 9 through 14) having a plurality of spiraling conduits 182 originating a fluid flow path at said lubricant inlet manifold 105, providing a spiraling flow path which discharges into the centralized core filter section 150.

The enclosed reclamation apparatus 100 is fabricated having an enclosed filter assembly housing 102 encasing the reclamation configuration. An inter-coupling surface of the enclosed filter assembly housing 102 includes various flow ports, including a plurality of lubricant inlet ports 104, providing an inlet flow conduit for the lubricant, and a lubricant outlet port 106 providing a discharge flow conduit for the lubricant. The enclosed reclamation apparatus 100 is optionally coupled to the reclamation system via a filter mount threading 112.

The reclamation configuration can be defined into three separate subsections: a centralized core filter section 150, a peripheral filter section 170, and a base filtering section 190. The centralized core filter section 150 (detailed in FIG. 5 herein) utilizes two independent filtration systems: a series of core filtering laminates 154 being disposed about a central section (a core conduit 152) of the centralized core filter section 150 and a series of crossover filtering materials positioned proximate the centralized core filter section 150—peripheral filter section 170 interface. Each core filtering laminates 154 can be fabricated having layers such as an outermost permeable laminate 156, a central permeable laminate 158, and an innermost permeable laminate 160. The various layers can be of the same or differing materials, and any number of layers, based upon the desired filtration characteristics. The passageway through the layers 156, 158, 160 can additionally generate liquid resonance, each resonance being fed via a transitional flow such as flows 310, 312, 314 (FIG. 6).

The peripheral filter section 170 includes a peripheral filtering material 178 surrounding a plurality of flow conduits, such as the various configurations of the substantially vertical peripheral flow conduit 172, the spiraling conduit 182, and the like. The conduits can optionally include a filtration material disposed therein. The conduit filtration material can be similar or distinct compared to the peripheral filtering material 178. The base filtering section 190 includes a base filtering material 192 providing additional filtration. The flow transfers the processed lubricant into a lubricant return pathway 196 passing through a secondary base filtering material 194. An additive impregnated core 198 can be used in conjunction with or replace the secondary base filtering material 194, wherein the additive impregnated core 198 is impregnated with a time releasing lubricant additive.

Flow rates of lubricant flowing through the lubricant return pathway 196 can be controlled via any number of ways. One such means utilizes an electrically or pneumatically operated flow control such as an adjustable shutter. Another is via material selection. The secondary base filtering material 194/additive impregnated core 198 can be exchangeable or replaceable via a removable section at the respective end of the enclosed filter assembly housing 102. The frame structure of the secondary base filtering material 194 can be designed incorporating a series of apertures having cross sectional areas that change along the direction of flow, thus accelerating or de-accelerating the flow rates. The secondary base filtering material 194 can be impregnated with a dissolving material, whereto the flow rate changes over the life cycle of the secondary base filtering material 194. The secondary base filtering material 194 can be impregnated with a low viscosity fluid additive further controlling the flow rate as well as providing absorption of the fluid additive. The secondary base filtering material 194 provides a means for pressure equalization throughout the various flow channels of the reclamation system.

In a preferred embodiment, the finest filtration flow passes in accordance with the base filtering flow 308 and is processed through the secondary base filtering material 194/additive impregnated core 198. The secondary base filtering material 194/additive impregnated core 198 is illustrated having a framework fabricated via an extrusion, molding, or other process. The additive impregnated core 198 preferably has a honeycomb cross-section, but can be of any selected geometry. The framework can be formed incorporating a time releasing lubricant additive. The secondary base filtering material 194 can be inserted within the open sections of the framework of the additive impregnated core 198. The secondary base filtering material 194 is dense enough to allow a predetermined flow rate of lubricant (having a specific viscosity and temperature range) to be forced through the secondary base filtering material 194. The secondary base filtering material 194 can, but not necessarily, be the same material as the base filtering material 192.

The secondary base filtering material 194/additive impregnated core 198 can comprise an electrically driven processing device such as an ionization device. The electrically driven processing device is controlled via electrical communication with the electrical array member 130. Alternately, the secondary base filtering material 194 can be of a material having magnetic properties.

Figure 5:
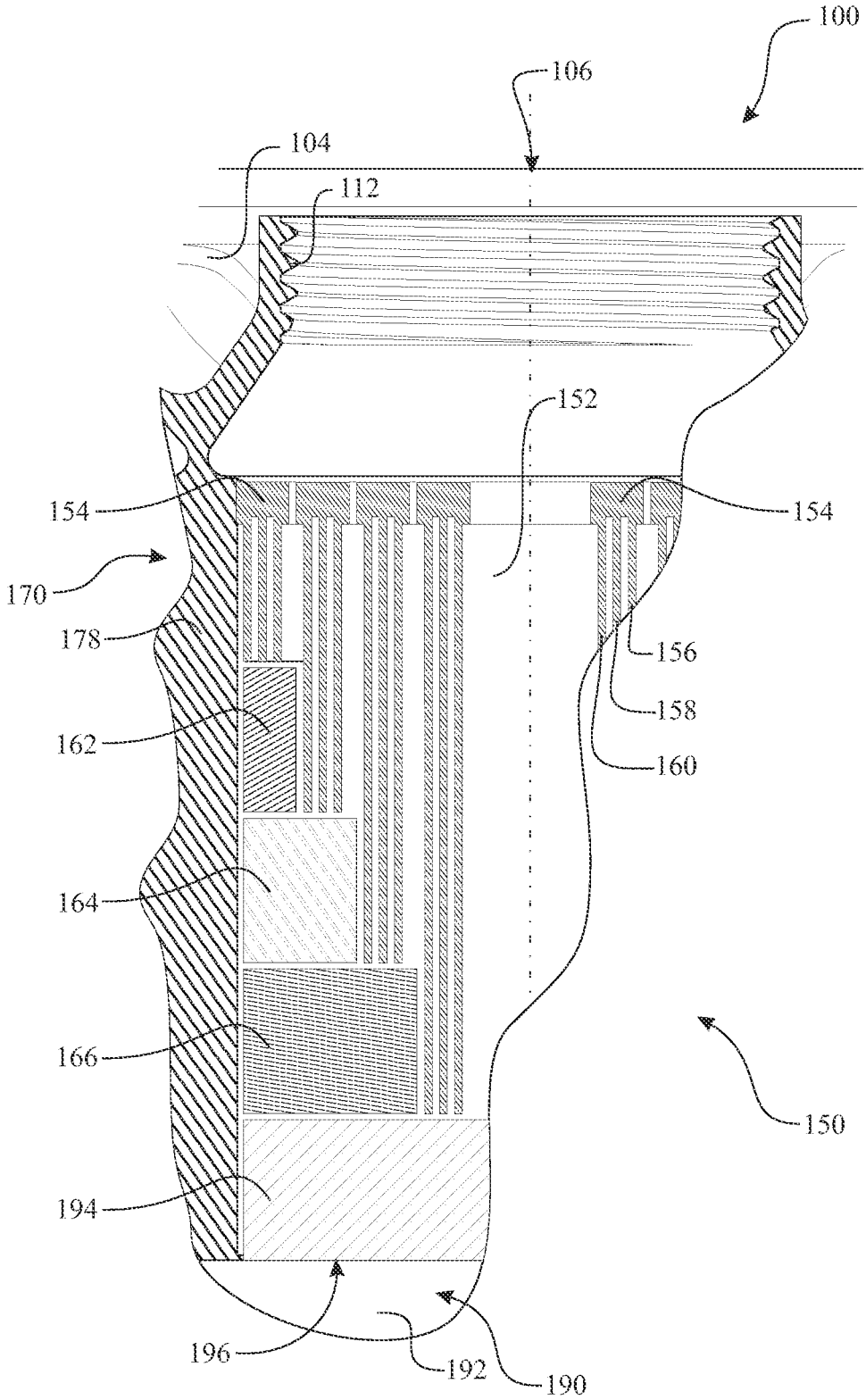
FIG. 5 presents a detailed view of a portion of a centralized core filter section of the enclosed reclamation device of FIG. 1.
Figure 6:
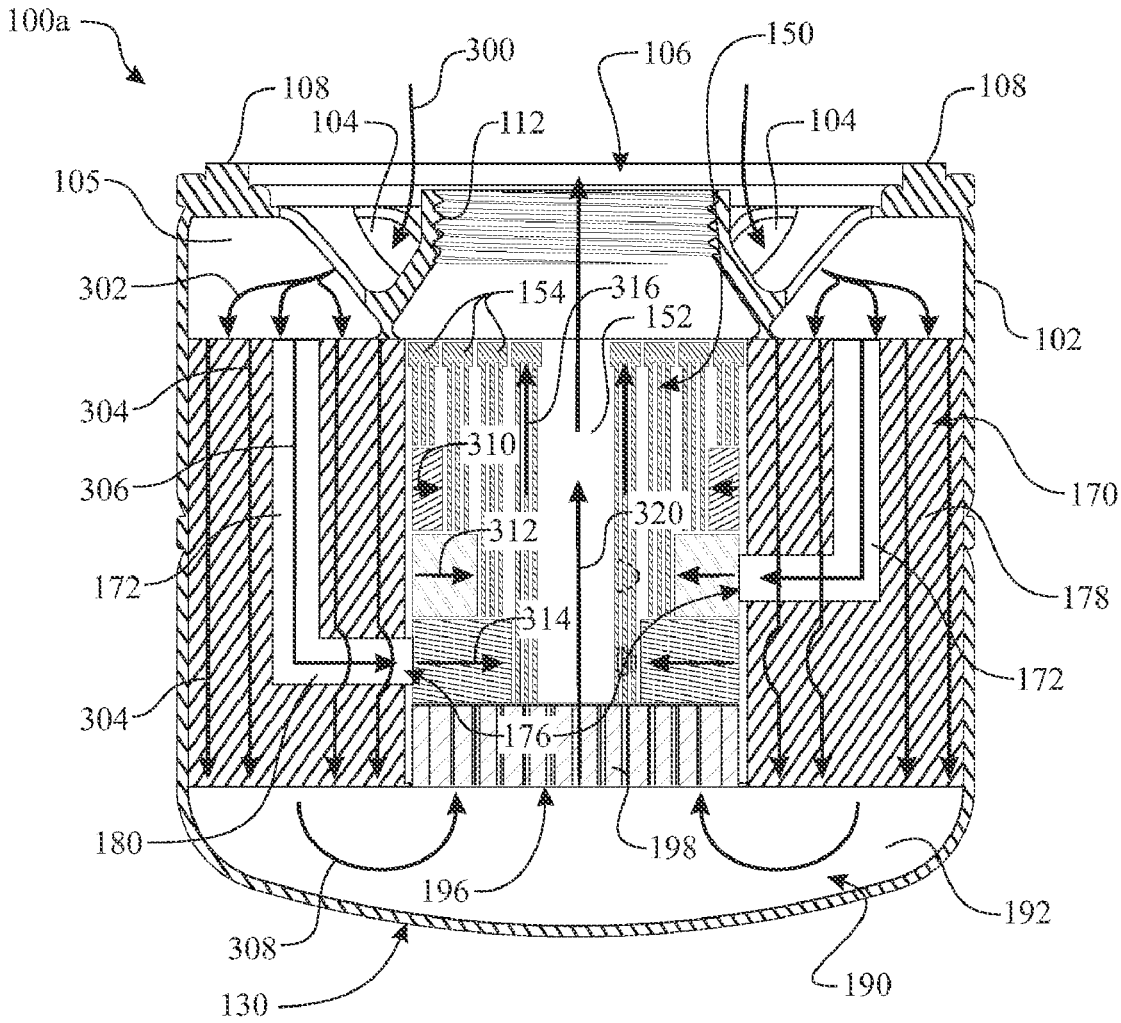
FIG. 6 presents a sectioned view of the enclosed reclamation device taken along section 4-4 of FIG. 1 describing a representative flow path of a second (redirecting) peripheral flow conduit configuration.
Figure 7:
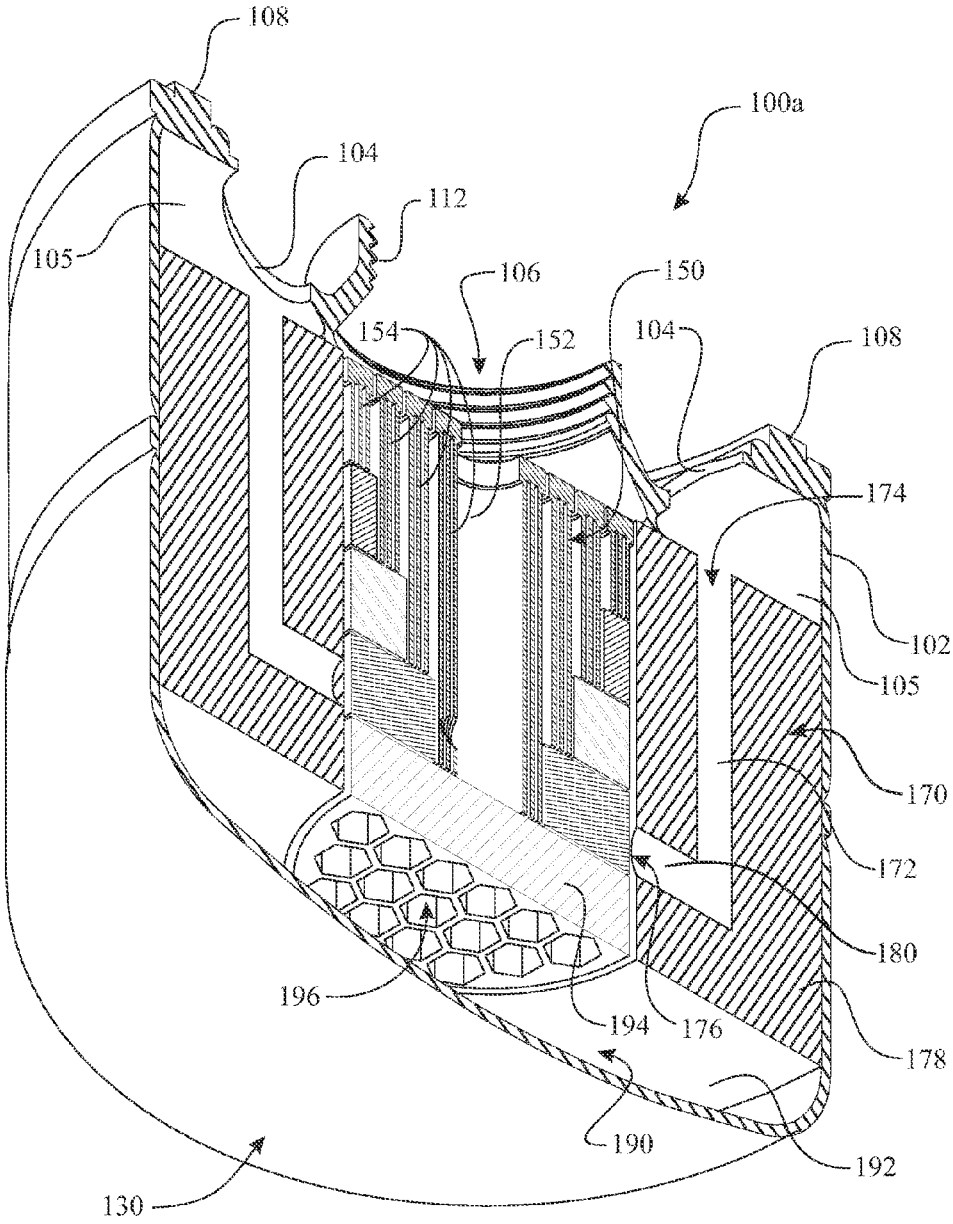
FIG. 7 presents an isometric sectioned view of the enclosed reclamation device previously illustrated in FIG. 6.
Figure 8:
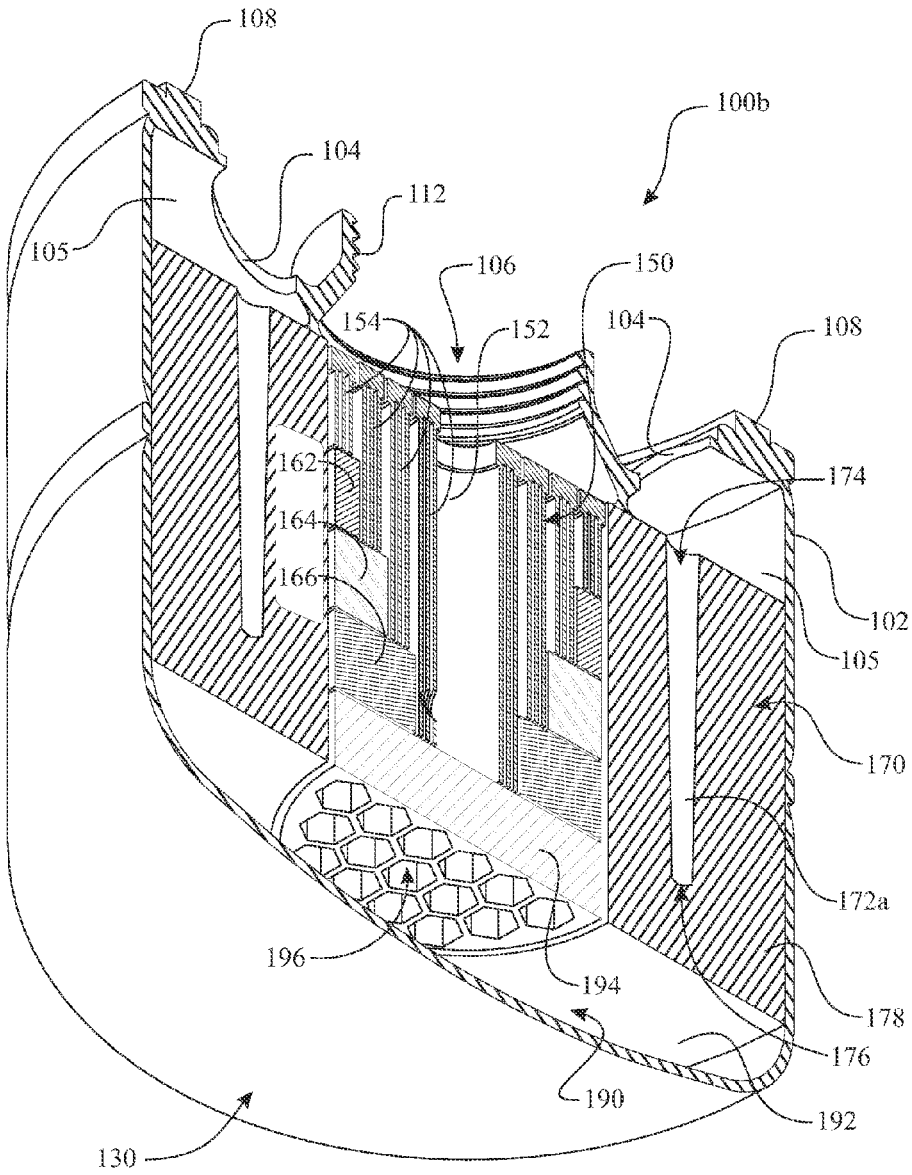
FIG. 8 presents an isometric sectioned view of the enclosed reclamation device taken along section 4-4 of FIG. 1, presenting a third (tapering) peripheral flow conduit configuration.
Figure 9:
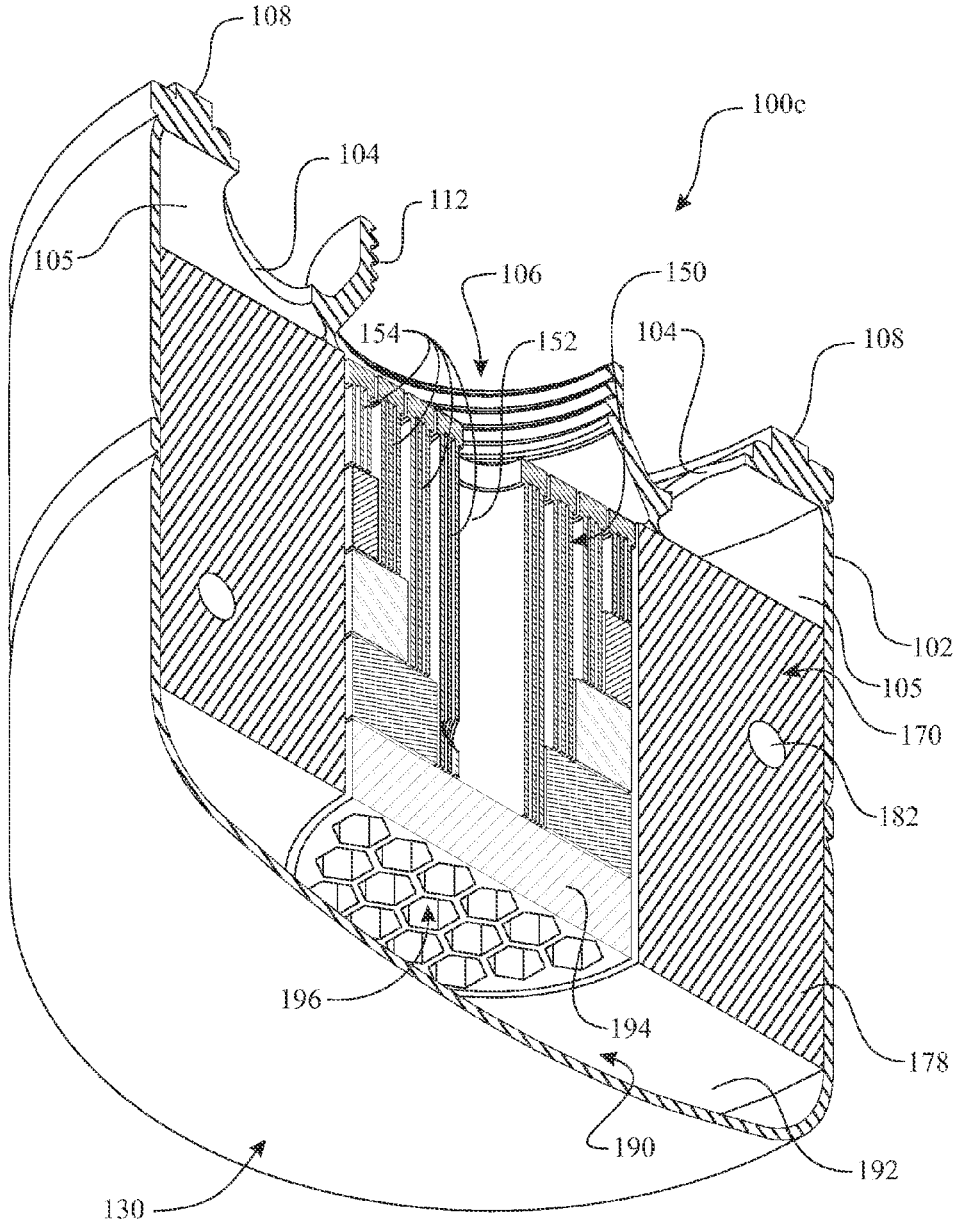
FIG. 9 presents an isometric sectioned view of the enclosed reclamation device taken along section 4-4 of FIG. 1, presenting a fourth (spiraling) peripheral flow conduit configuration.
Figure 10:
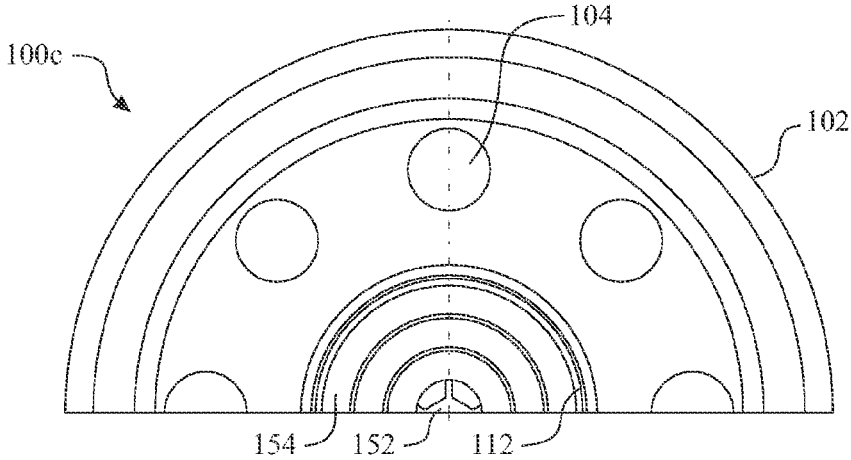
FIG. 10 presents a top view of the enclosed reclamation device.
Figure 11:
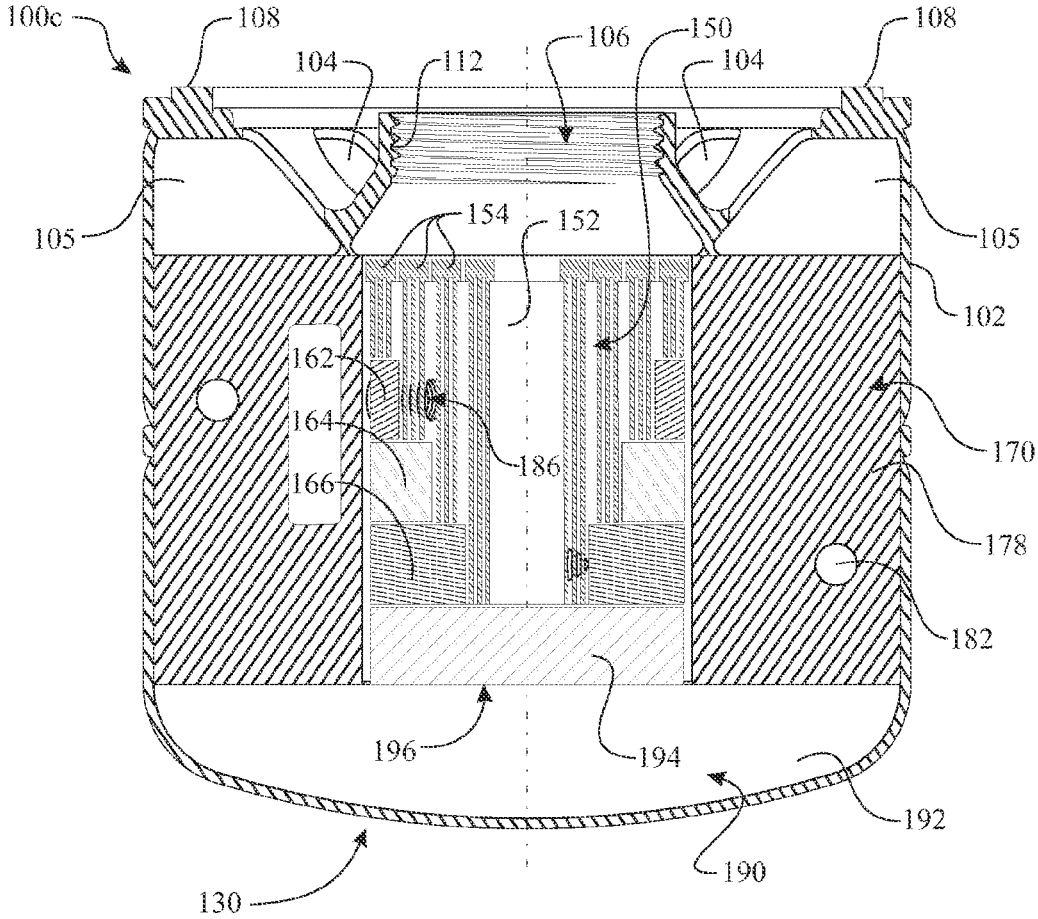
FIG. 11 presents an elevation sectioned view of the enclosed reclamation device taken along section 4-4 of FIG. 1, presenting the fourth (spiraling) peripheral flow conduit configuration and a base filtration system.

A representative flow path is demonstrated in FIG. 6 with details of the centralized core filter section 150 being provided in an exploded portional view illustrated in FIG. 5. Flow enters the enclosed reclamation apparatus 100 via an inlet flow 300 passing through the series of lubricant inlet ports 104 into a lubricant inlet manifold 105. The flow is distributed via a manifold distributing flow 302 passing partially into a peripheral filtering material 178 (via peripheral filtering flow 304) and partially into the incorporated peripheral conduits (wherein a substantially vertical peripheral flow conduit 172 is presented in the exemplary embodiment) (via peripheral conduit flow 306). The exemplary embodiment redirects the peripheral conduit flow 306 within the substantially vertical peripheral flow conduit 172 via a substantially horizontal peripheral flow conduit 180 discharging the flow via an exit port of the peripheral conduit such as a peripheral conduit exit 176 shown in the exemplary embodiment. The horizontal positioning of the substantially horizontal peripheral flow conduit 180 can vary and is preferably such to position the respective peripheral conduit exit 176 discharging into each of a first core crossover filtering material 162, a second core crossover filtering material 164, and a nth core crossover filtering material 166, providing flows upper transitional flow 310, mid-level transitional flow 312 and lower transitional flow 314 respectively. It is recognized that the transitional flows 310, 312, 314 can continue radially through the series of layers of the core filtering laminates 154. The crossover filtering materials 162, 164, 166 can be of a variety of designs, including having a permeable wall, a filtration material disposed therein, a flow through port, an electrically charged membrane, a pneumatically activated design, and the like. The configurations can discharge the lubricant along the filter's axial direction, along the radial direction (as shown), or both. Although not shown, the filter can be design providing lubricant flow directly from the peripheral filtering material 178 and the core filtering laminates 154, crossover filtering materials 162, 164, and 166.

A base filtering flow 308 collects lubricant from the peripheral filtering flow 304, processes the lubricant within base filtering section 190 via a base filtering material 192 and passes the lubricant through an additive impregnated core 198, into the centralized core filter section 150. Lubricant can flow through the core filtering laminates 154 axially via a laminate filtering flow 316, radially (parallel to the transitional flow 310), or both. The lubricant within the filter exits via a collective discharging flow 320, exiting via the lubricant outlet port 106.

The configuration of the peripheral conduits can vary dependant upon the desired filtration process. In accordance with the first embodiment filter 100, a substantially vertical peripheral flow conduit 172 passes substantially vertically between a lubricant inlet manifold 105 and a base filtering material 192. A plurality of substantially vertical peripheral flow conduits 172 are disposed within the peripheral filter section 170, preferably in a circular pattern, evenly distributed about the center of the filter 100. A peripheral conduit entrance 174 provides fluid communication between the lubricant inlet manifold 105 and the substantially vertical peripheral flow conduit 172, providing an entrance port for the peripheral conduit flow 306. A filtration material can be disposed within the substantially vertical peripheral flow conduit 172 providing additional filtration. Alternately, the substantially vertical peripheral flow conduit 172 can be hollow providing reduced flow resistance for the lubricant, such that a portion of the lubricant flows, exiting via a peripheral conduit exit 176 directly into the base filtering section 190.

In accordance with the second embodiment filter 100*a*, a substantially vertical peripheral flow conduit 172 provides a fluid flow path substantially vertical from said lubricant inlet manifold 105 towards said base filtering material 192, being redirected via a plurality of substantially horizontal peripheral flow conduits 180, exiting through the peripheral conduit exit 176 into a centralized core filter section 150. A plurality of substantially vertical peripheral flow conduits 172 is disposed within the peripheral filter section 170, preferably in a circular pattern, evenly distributed about the center of the filter 100*a*. The peripheral conduit entrance 174 provides fluid communication between the lubricant inlet manifold 105 and the substantially vertical peripheral flow conduit 172, providing an entrance port for the peripheral conduit flow 306. Filtration material can be disposed within the substantially vertical peripheral flow conduit 172 providing additional filtration. Alternately, the substantially vertical peripheral flow conduit 172 can be hollow providing reduced flow resistance for the lubricant, such that a portion of the lubricant flows, exiting via a peripheral conduit exit 176 directly into the centralized core filter section 150. The exiting flow is presented as upper transitional flow 310, mid-level transitional flow 312, and lower transitional flow 314.

In accordance with the third embodiment filter 100*b*, a substantially vertical peripheral flow conduit 172*a* provides tapering from an entrance diameter to a smaller exiting diameter, the discharging diameter being either within a peripheral filtering material 178 or into said base filtering material 192. A plurality of substantially vertical peripheral flow conduits 172*a* are disposed within the peripheral filter section 170, preferably in a circular pattern, evenly distributed about the center of the filter 100*b*. The peripheral conduit entrance 174 provides fluid communication between the lubricant inlet manifold 105 and the substantially vertical peripheral flow conduit 172, providing an entrance port for the peripheral conduit flow 306. Filtration material can be disposed within the substantially vertical peripheral flow conduit 172 providing additional filtration. Alternately, the substantially vertical peripheral flow conduit 172 can be hollow providing reduced flow resistance for the lubricant, such that a portion of the lubricant flows, exiting via a peripheral conduit exit 176 into the centralized core filter section 150. The wall of the substantially vertical peripheral flow conduit 172 can be fabricated of a porous material, allowing the lubricant to pass through the wall of the substantially vertical peripheral flow conduit 172. The spiraling configuration introduces a centrifugal force to the lubricant, which can be utilized as a function of the filtration process.

Figure 12:
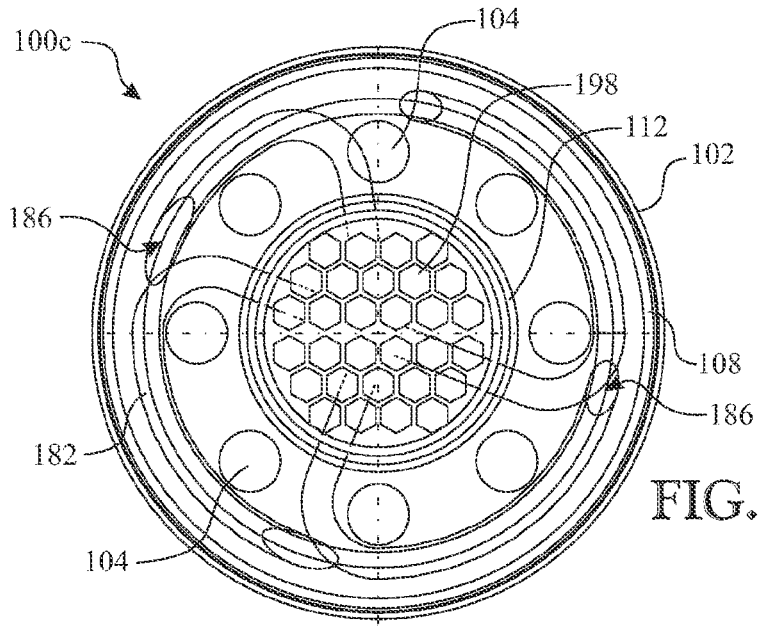
FIG. 12 presents a top view of the enclosed reclamation device, illustrating a top view of a portion of the internal filtration members.
Figure 13:
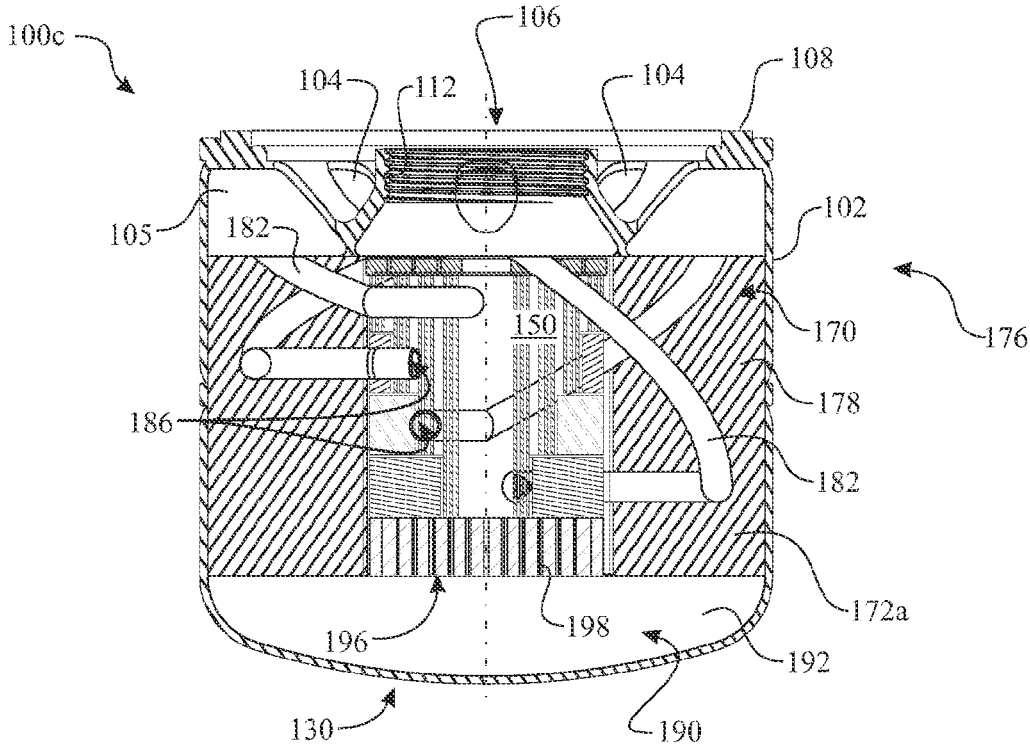
FIG. 13 presents an elevation sectioned view of the enclosed reclamation device of FIG. 12, enhancing details of the spiraling peripheral flow conduit configuration and introducing an additive impregnated core.
Figure 14:
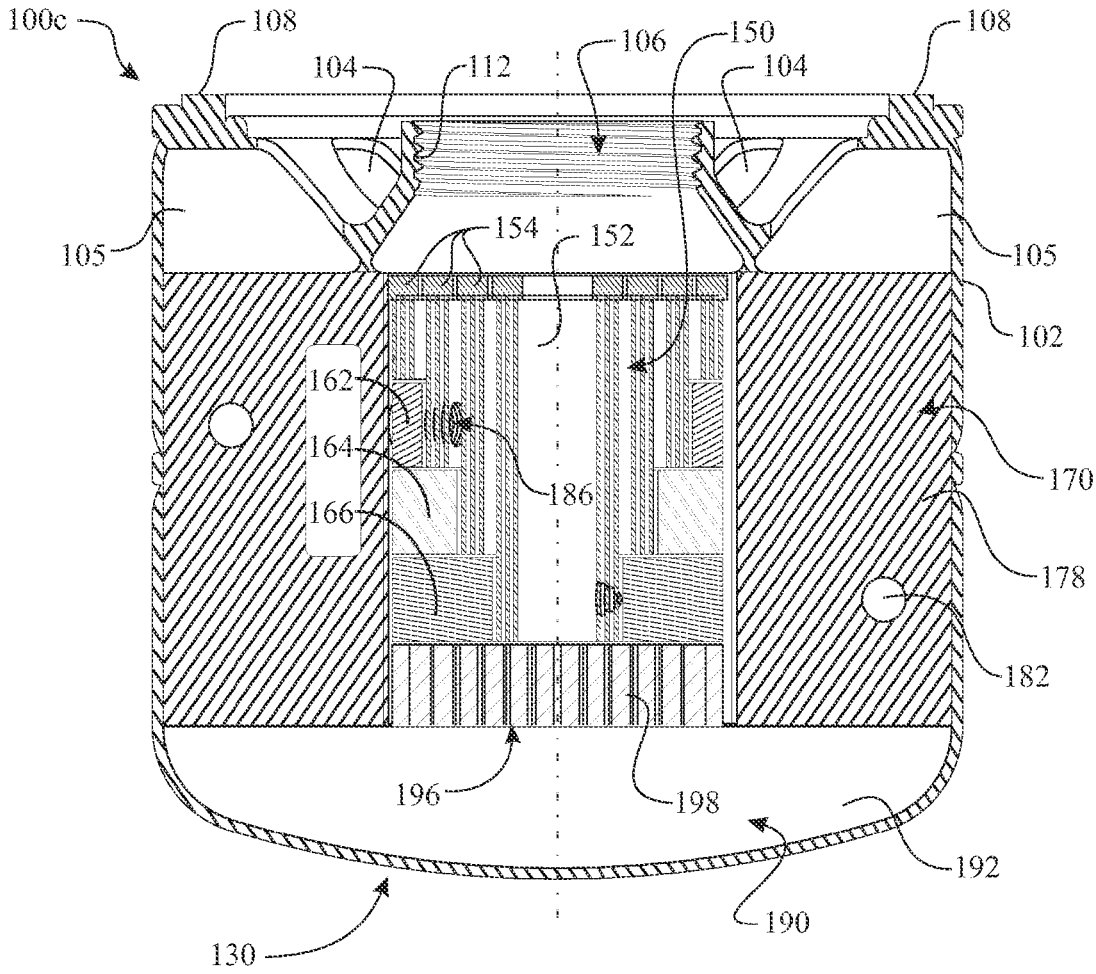
FIG. 14 presents an elevation sectioned view of the enclosed reclamation device of FIG. 13.

In accordance with the fourth embodiment filter 100*c*, a spiraling conduit 182 provides a spiraling fluid flow path directed from said lubricant inlet manifold 105 discharging into said centralized core filter section 150, A plurality of spiraling conduits 182 are disposed within the peripheral filter section 170, preferably in a circular pattern, evenly distributed about the center of the filter 100*c* (FIG. 12). A peripheral conduit entrance 174 provides fluid communication between the lubricant inlet manifold 105 and the spiraling conduit 182, providing an entrance port for the peripheral conduit flow 306. Filtration material can be disposed within the substantially vertical peripheral flow conduit 172 providing additional filtration. Alternately, the substantially vertical peripheral flow conduit 172 can be hollow providing reduced flow resistance for the lubricant, such that a portion of the lubricant flows, exiting via a spiraling conduit exit port 186 into a lower portion of the peripheral filtering material 178. The wall of the substantially vertical peripheral flow conduit 172 can be fabricated of a porous material, allowing the lubricant to pass through the wall of the substantially vertical peripheral flow conduit 172.

The conduits 172, 182 can optionally be fabricated of an electrically conductive or magnetic material. For an electrically conductive embodiment, the electrically conductive portion of the conduits 172, 182 can be in electrical communication with the electrical interface of the electrical array member 130. The interfacing configurations presented via enclosed registering reclamation device 200 and pass through reclamation device 220 ensure proper registration between components, thus providing a means for registering electrical communication between the components.

The various filtration materials can be designed to control the flow direction, volume, and rates by utilizing specific materials having differing permeability's. Additionally, the filter 100 provides simple customization via changes in the selected filtration materials. The filter fabricator would select the various components to match a desired filtration application and assemble accordingly.

The above description is considered that of the preferred embodiments only. Modifications of the invention will occur to those skilled in the art and to those who make or use the invention. Therefore, it is understood that the embodiments shown in the drawings and described above are merely for illustrative purposes and are not intended to limit the scope of the invention, which is defined by the following claims as interpreted according to the principles of patent law, including the doctrine of equivalents.

We claim:

1. An oil reclamation system, the system comprising:

a filter housing providing an exterior shell and an interfacing surface, said interfacing surface comprising a series of lubricant inlet ports, at least one lubricant discharge port, and a mounting feature for providing said housing in fluid communication with a lubricant source;

an inlet manifold in fluid communication with said series of lubricant inlet ports;

a centralized filtration system disposed about a longitudinal axis, proximate a center of said filter housing, said centralized filtration system comprising a filtration configuration providing filtration and a core conduit, wherein said core conduit is in fluid communication with said at least one lubricant discharge port; and a peripheral filtration system disposed about an internal periphery of said filter housing, said peripheral filtration system comprising a filtering material and a plurality of peripheral conduits disposed within said filtering material, wherein said plurality of peripheral conduits are in fluid communication with said inlet manifold;

wherein said peripheral filtration system is in at least one of directly and indirectly in fluid communication with said centralized filtration system at least one stacking array member, said at least one array member disposed between said filter housing mounting feature and said lubricant source, said stacking array member comprising:

an array body;

a lubricant outlet conduit passing through said array body;

a series of array inlet processing lubricant conduits passing through said array body and located about said outlet conduit; and each at least one said stacking array member further comprising at least one of:

a) an electrical receptacle in electrical communication with at least one of an electrically driven processing device and an electrically operated monitoring device, and b) a pneumatic receptacle in pneumatic communication with at least one of a pneumatically driven processing device and a pneumatically operated monitoring device.

2. An oil reclamation system as recited in claim 1, the system comprising said electrical receptacle in electrical communication with at least one of said electrically driven processing device and said electrically operated monitoring device.

3. An oil reclamation system as recited in claim 2, the system comprising said pneumatic receptacle in pneumatic communication with at least one of said pneumatically driven processing device and said pneumatically operated monitoring device.

4. An oil reclamation system as recited in claim 2, wherein said filtration configuration of said centralized filtration system includes a core conduit in fluid communication with a lubricant exit port and at least one of:

a. a plurality of core filtering laminates disposed substantially parallel with and circumferentially disposed about said core conduit; and b. at least one core crossover filtration material disposed between said peripheral filtration system and said core filtering laminates; and wherein said core filtering laminates are electrically conductive and in electrical communication with said electrical receptacle.

5. An oil reclamation system as recited in claim 2, wherein said peripheral conduits comprise an electrically conductive material, wherein said electrically conductive material is in electrical communication with said electrical receptacle.

6. An oil reclamation system as recited in claim 5, said filter housing further comprising a re-engaging base section; and said base filtration section further comprising at least one base filtration material, wherein said base filtration material can be replaced via removal and reassembly of said re-engaging base section.

7. An oil reclamation system as recited in claim 6, said base filtration section further comprising a lubricant additive.

8. An oil reclamation system as recited in claim 1, the system comprising said pneumatic receptacle in pneumatic communication with at least one of said pneumatically driven processing device and said pneumatically operated monitoring device.

9. An oil reclamation system as recited in claim 1, wherein said filtration configuration of said centralized filtration system includes a core conduit in fluid communication with a lubricant exit port and at least one of:

a. a plurality of core filtering laminates disposed substantially parallel with and circumferentially disposed about said core conduit; and b. at least one core crossover filtration material disposed between said peripheral filtration system and said core filtering laminates.

10. An oil reclamation system as recited in claim 9, said centralized filtration system comprising a first core crossover filtration material and at least a second core crossover filtration material, wherein said first core crossover filtration material differs in filtration properties from said second core crossover filtration material.

11. An oil reclamation system as recited in claim 1, said system further comprising a base filtration section located in fluid communication between said centralized filtration system and said peripheral filtration system.

12. An oil reclamation system as recited in claim 11, said base filtration section further comprising a lubricant additive.

13. An oil reclamation system, said system comprising:

a filter housing providing an exterior shell and an interfacing surface, said interfacing surface comprising a series of lubricant inlet ports, at least one lubricant discharge port, and a mounting feature for providing said housing in fluid communication with a lubricant source;

an inlet manifold in fluid communication with said series of lubricant inlet ports;

at least one filtration system enclosed within said filter housing and located in flow relation between said series of lubricant inlet ports and said at least one lubricant discharge port; and a stacking array member, said array member disposed between said filter housing mounting feature and said lubricant source, said stacking array member comprising:

an array body;

a lubricant outlet conduit passing through said array body and in fluid communication with said at least one lubricant discharge port;

a series of array inlet processing lubricant conduits passing through said array body and located about said outlet conduit and in fluid communication with said series of lubricant inlet ports; and said stacking array member further comprising at least one of:

a) an electrical receptacle in electrical communication with at least one of an electrically driven processing device and an electrically operated monitoring device, and b) a pneumatic receptacle in pneumatic communication with at least one of a pneumatically driven processing device and a pneumatically operated monitoring device.

14. An oil reclamation system as recited in claim 13, said filter housing further containing at least one of an electrically driven processing device and an electrically operated monitoring device; and said at least one of an electrically driven processing device and an electrically operated monitoring device is in electrical communication with said electrical receptacle of said stacking array member.

15. An oil reclamation system as recited in claim 14, wherein said electrically driven processing device is at least one element of said at least one filtration system.

16. An oil reclamation system as recited in claim 13, said at least one filtration system comprising:

a core conduit in fluid communication with said at least one lubricant discharge port;

a core filter section located about and in fluid communication with said core conduit and having a plurality of core filtering laminates;

wherein said core filtering laminates comprise a component that is electrically conductive and in electrical communication with said electrical receptacle of said stacking array member.

17. An oil reclamation system as recited in claim 13, said at least one filtration system comprising:

a core conduit in fluid communication with said at least one lubricant discharge port;

a core filter section located about and in fluid communication with said core conduit;

a peripheral filter section located about a periphery of said core filter section and having a series of peripheral conduits disposed therein;

wherein said peripheral conduits comprise a component that is electrically conductive and in electrical communication with said electrical receptacle of said stacking array member.

18. An oil reclamation system, the system comprising:

a filter housing providing an exterior shell and an interfacing surface, said interfacing surface comprising a series of lubricant inlet ports, at least one lubricant discharge port, and a mounting feature for providing said housing in fluid communication with a lubricant source;

an inlet manifold in fluid communication with said series of lubricant inlet ports;

a centralized filtration system disposed about a longitudinal center of said filter housing, said centralized filtration system comprising a filtration configuration and a core conduit, wherein said core conduit is in fluid communication with said at least one lubricant discharge port; and a peripheral filtration system disposed about an internal periphery of said filter housing, said peripheral filtration system comprising a filtering material and a plurality of peripheral conduits disposed within said filtering material, wherein said plurality of peripheral conduits are in fluid communication with said inlet manifold; and a stacking array member, said array member disposed between said filter housing mounting feature and said lubricant source, said stacking array member comprising:

an array body;

a lubricant outlet conduit passing through said array body and in fluid communication with said at least one lubricant discharge port;

a series of array inlet processing lubricant conduits passing through said array body and located about said outlet conduit and in fluid communication with said series of lubricant inlet ports; and said stacking array member further comprising at least one of:

a) an electrical receptacle in electrical communication with at least one of an electrically driven processing device and an electrically operated monitoring device, and b) a pneumatic receptacle in pneumatic communication with at least one of a pneumatically driven processing device and a pneumatically operated monitoring device.

19. An oil reclamation system as recited in claim 18, said filter housing further containing at least one of an electrically driven processing device and an electrically operated monitoring device; and said at least one of an electrically driven processing device and an electrically operated monitoring device is in electrical communication with said electrical receptacle of said stacking array member.

20. An oil reclamation system as recited in claim 19, wherein said electrically driven processing device is at least one element of said at least one filtration system.

21. An oil reclamation system as recited in claim 19, said at least one filtration system comprising:

a core conduit in fluid communication with said at least one lubricant discharge port;

a core filter section located about and in fluid communication with said core conduit and having a plurality of core filtering laminates;

wherein said core filtering laminates comprise a component that is electrically conductive and in electrical communication with said electrical receptacle of said stacking array member.

22. An oil reclamation system as recited in claim 18, said at least one filtration system comprising:

a core conduit in fluid communication with said at least one lubricant discharge port;

a core filter section located about and in fluid communication with said core conduit;

a peripheral filter section located about a periphery of said core filter section and having a series of peripheral conduits disposed therein;

wherein said peripheral conduits comprise a component that is electrically conductive and in electrical communication with said electrical receptacle of said stacking array member.

23. An oil reclamation system as recited in claim 18, said system further comprising a base filtration section located in fluid communication between said centralized filtration system and said peripheral filtration system.

24. An oil reclamation system as recited in claim 23, said base filtration section further comprising a lubricant additive.

* * * * *